United States Patent [19]

Bock et al.

[11] 4,055,311

[45] Oct. 25, 1977

[54] DEVICE FOR WINDING UP YARNS

[75] Inventors: Jürgen Bock, Bobingen, Germany; Hans-Jürgen Strutz, Spartanburg, S.C.

[73] Assignee: Hoechst Aktiengesellschaft, Frankfurt am Main, Germany

[21] Appl. No.: 591,303

[22] Filed: June 27, 1975

[30] Foreign Application Priority Data

July 4, 1974 Germany ..... 2432166

[51] Int. Cl.[2] ..... B65H 54/40; B65H 75/18

[52] U.S. Cl. ..... 242/18 DD; 242/118.3; 242/178

[58] Field of Search ..... 242/18 DD, 118, 118.1, 242/118.11, 118.2, 118.3, 118.31, 118.32, 159, 172–178, 43 R

[56] References Cited

U.S. PATENT DOCUMENTS

| | | | |
|---|---|---|---|
| 2,004,153 | 6/1935 | Brainard | 242/18 DD |
| 3,831,362 | 8/1974 | Dudzik | 242/18 DD |

FOREIGN PATENT DOCUMENTS

| | | | |
|---|---|---|---|
| 1,117,668 | 2/1956 | France | 242/18 DD |
| 678,463 | 7/1939 | Germany | 242/18 DD |

*Primary Examiner*—Stanley N. Gilreath
*Attorney, Agent, or Firm*—Connolly and Hutz

[57] ABSTRACT

A device for winding up yarns on bobbins is described. The empty bobbins are driven by means of a friction roll via their surface, that is, via the winding with proceeding windup operation. The yarn is traversed over the complete length of the winding on the bobbin by means of a traversing device, and it has been observed that the winding is thicker at the points of reverse travel of the traversing device than in the central section of the winding, and that the yarn sections at these points of reverse travel are subjected to a heavy mechanical strain by the friction roll. This strain is avoided by decreasing the diameter of the empty bobbin relative to the center of the empty bobbin in the vicinity of reverse travel of the traversing device.

1 Claim, 6 Drawing Figures

DEVICE FOR WINDING UP YARNS

Figure 1:
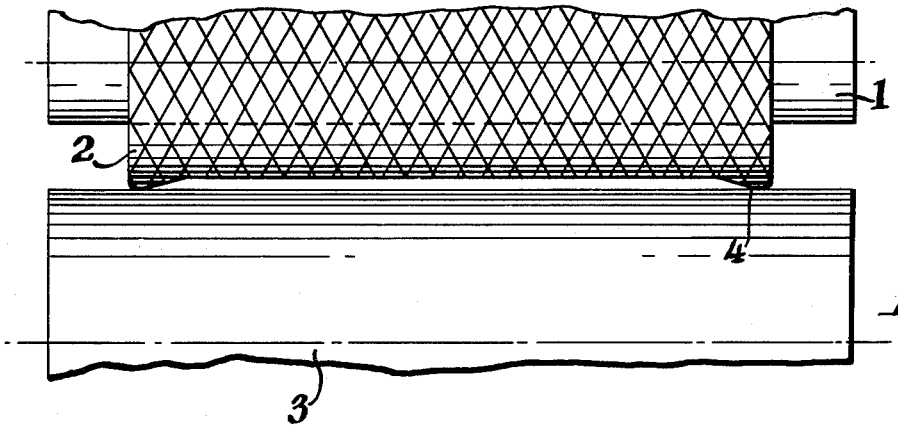

The present invention provides a device for winding up yarns on empty bobbins which comprises an empty bobbin rotating on a clamping device, a friction roll contacting the surface of the empty bobbin and corresponding drive means, and a traversing device for the yarn to be wound up.

In the manufacture of filament yarns from synthetic high polymers, for example polyamides or polyesters, the filament yarns are manufactured by melt-spinning, drawn off at a speed of up to several thousand meters, and wound up. These spun yarns are generally drawn in a further operation and often also subjected to crimping or texturizing processes.

It has been observed that periodic dyeing faults occur repeatedly in woven or knitted fabrics made from yarns of synthetic high polymers. According to our own observations, the distance between these faults corresponds to the length of yarn which, taking into consideration all drawing and shrinkage processes, is identical to the traversing period of the wind-up operation to which the freshly melt-spun yarn is subjected.

In the case of winders with cross-wound cheese, that is, winders running by friction roll drive, a compression force of the roll on the bobbin of up to several kilograms has been stated. Furthermore, it has been observed that this force does not act as a linear force over the complete length of the cylindrical bobbin, but substantially on the end points, that is, the points of reverse travel, where a certain piling-up of material nearly cannot be avoided. This strain on the points of reverse travel causes heavy milling of the yarn wound up and thus mechanic and/or thermal damage of especially the lower layers of the yarn on the bobbin, which later on appear as periodic dyeing faults in the finished goods.

In the course of the wind-up operation, however, the increasing diameter of the bobbin ensures a certain compensation, so that the damages are correspondingly reduced.

It is known to prevent such damage of the yarn at the start of the wind-up operation by means of so-called starter rings. In this case, the diameter of the friction roll and/or the winding mandrel (chuck) is increased at the ends outside of the range of travel, so that, at the beginning of the wind-up operation, the friction drive does not act on the whole length of the bobbin, but exclusively on these starter rings. Only when the yarn wound up has given the bobbin a sufficient diameter, the friction roll acts directly on the bobbin in usual manner. This measure taken brings about a considerable correction of the above faults in many cases; however, it cause alteration of tension and thus orientation, which also becomes apparent later on as a change of color. This alteration of tension is a function of the change of circumferential speed variable with time when starter rings are used, and thus limits their use.

It is an object of the present invention to avoid the abovementioned disadvantages and to provide a device for winding up yarns, of synthetic high polymers preferably preorientated yarns, at high speed, without causing alteration of orientation or other damages of the yarn. This and other objects and advantages will be apparent from the following detailed disclosure.

In accordance with this invention, there is provided a device wherein the diameter of the empty bobbin decreases relative to the center in the vicinity of reverse travel of the traversing device. Preferably, the empty bobbin diameter is at its lowest value in the section of reverse travel of the traversing device. Preferably, the empty bobbin diameters and the length of the empty bobbin and the winding on the bobbin correspond to the following unbalanced equations:

$$\text{a) } 0.05 \text{ mm} \leqq e_2 - e_1 \leqq 4 \text{ mm, and}$$

$$\text{b) } \frac{l_1 - m_3}{l_1} \leqq 1, \text{ and}$$

$$\text{c) } \frac{l_1 - m_2}{l_1} \leqq 0.3,$$

where $l_1$ is the length of the winding on the bobbin, $m_2$ is the smallest distance between the sections of the smallest bobbin diameter at the points of reverse travel of the traversing device, $m_3$ is the length of the section of unchanged diameter in the center of the empty bobbin between the two sections of decreasing empty bobbin diameter, $e_1$ is the empty bobbin diameter at the points of reverse travel, and $e_2$ is the maximum empty bobbin diameter between the points of reverse travel of the traversing device.

Preferably, both ends of the empty bobbin are provided with starter rings the diameter $e_3$ of which exceeds the diameter $e_2$ by less than 2mm, preferably less than 1.4mm, but at least 0.2 mm.

The device of the invention allows a trouble-free windup of yarns which are not damaged and maintain their uniform properties.

This invention will be better understood by reference to the drawings, of which

Figure 2:
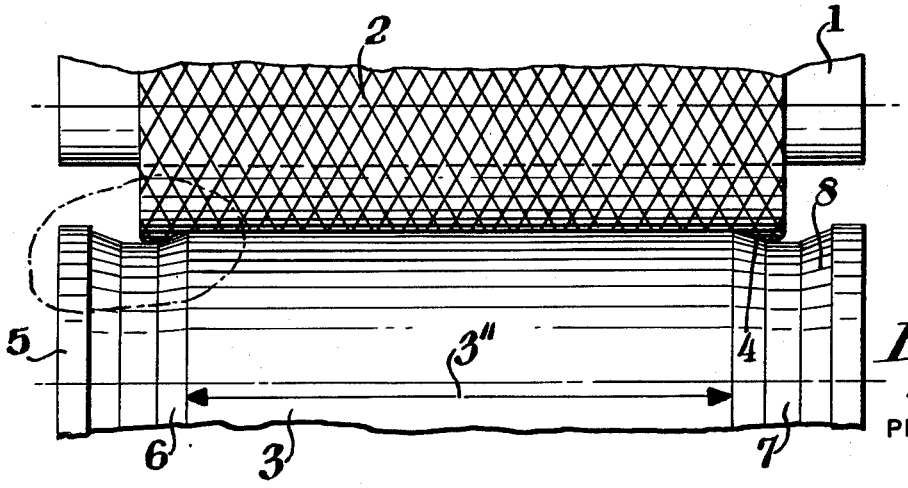
Fig. 2. PRIOR ART
Figure 3:
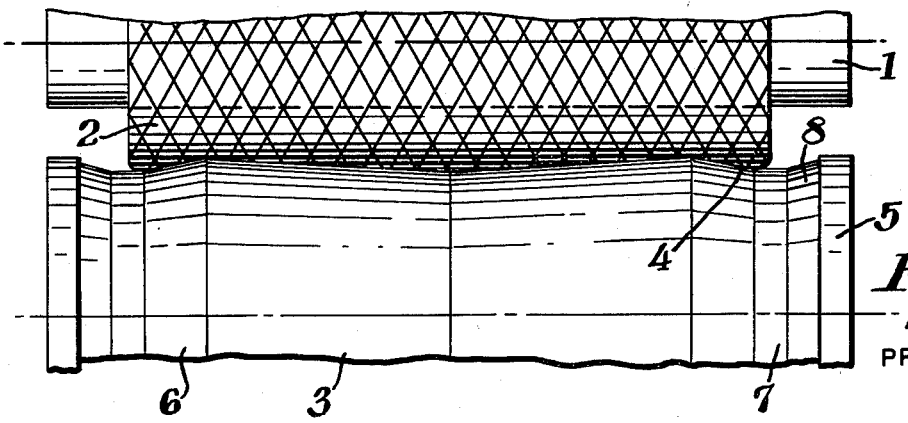
Fig. 3. PRIOR ART
Figure 4:
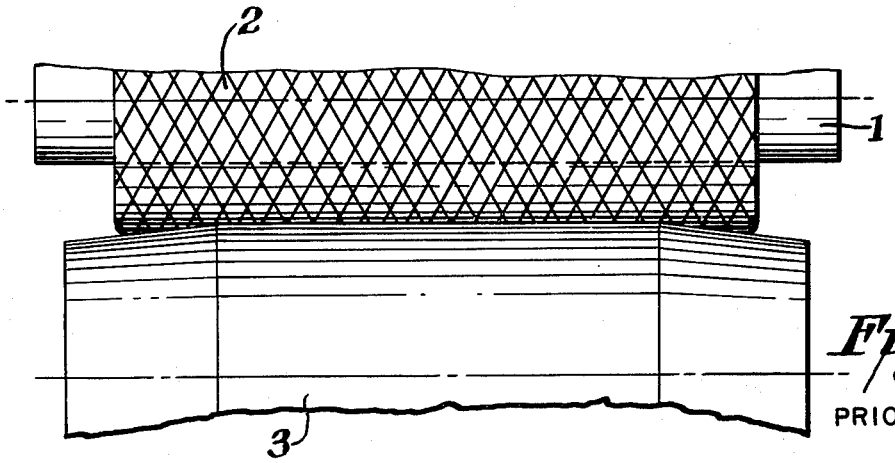
Fig. 4. PRIOR ART
Figure 5:
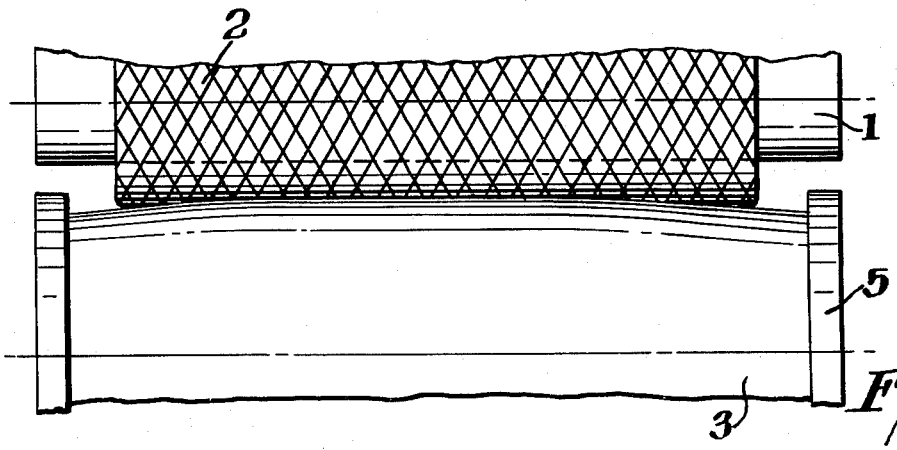
Fig. 5. PRIOR ART
Figure 6:
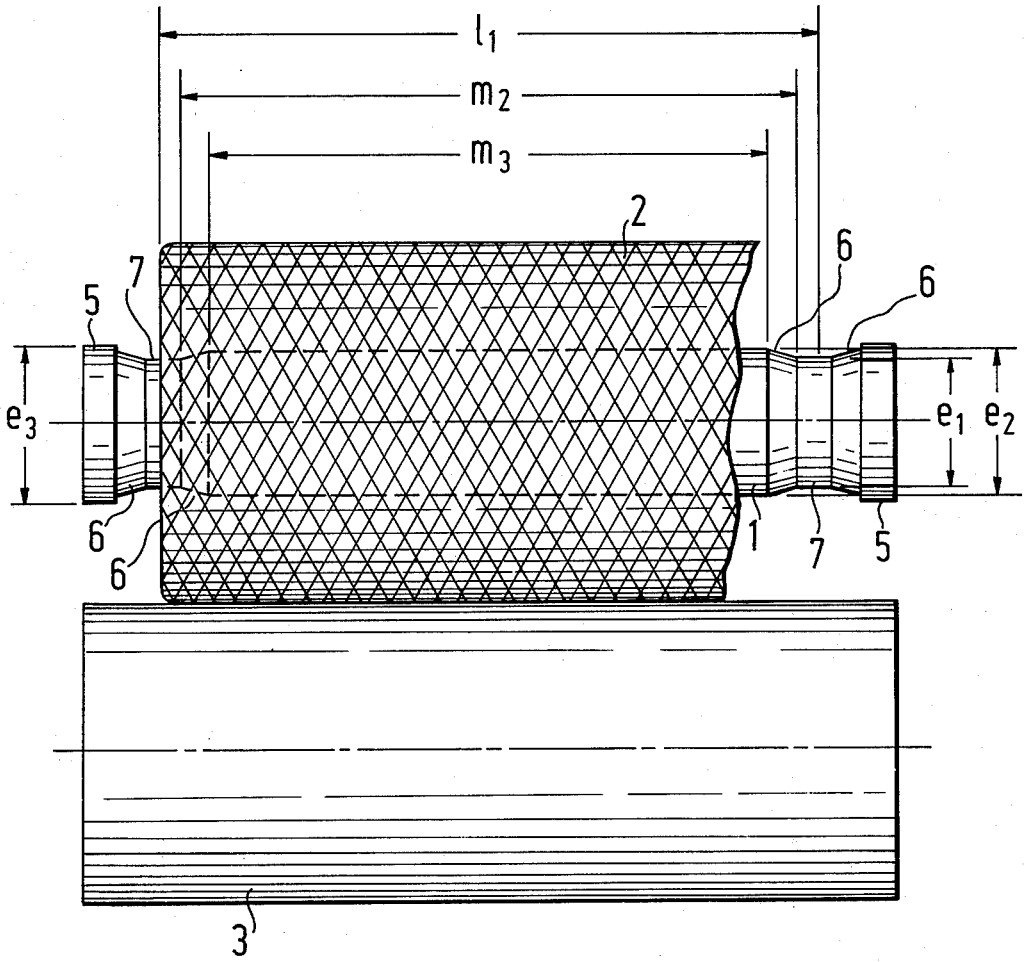

FIG. 1 is a schematic representation of a prior art bobbin with complete winding and a usual cylindrical friction roll, FIG. 2 is a schematic view of a prior art bobbin with complete winding and an indented friction roll, FIGS. 3 through 5 show further embodiments of prior art indended friction rolls, and FIG. 6 shows a schematic view of the preferred embodiment of the invention.

Referring now to FIGS. 1 through 6, the numbers 1, 2 and 3 represent the bobbin, the winding and the friction roll, respectively. FIG. 1 clearly shows — on an enlarged scale — that the material piled up at the points of reverse travel 4 causes the friction roll 3 to contact the winding only at the points of reverse travel 4 of the traversing device and thus the milling strain on the bobbin to increase correspondingly in these sections. The axial extension of the section of material piled up at the points of reverse travel generally amounts to a few millimeters only.

The friction roll 3 shown in FIG. 2 contains in its center a cylindrical section 3'', subsequently, in the direction towards the two points of reverse travel, two sections 6 of decreasing diameter which, in the section of reverse travel 7, attains the minimum value. The ends of the friction roll are shaped as starter rings 5 in this case.

During the complete wind-up operation, especially at the beginning, the yarn at the points of reverse travel is not adversely affected, since the section 7 of the friction roll is smaller in diameter. The winding 2 and the bobbin 1 are substantially driven by the cylindrical section 3'' of the friction roll, and for this reason, this section 3'' is generally shaped as large as possible. In some special cases, however, it is possible to renounce the cylindrical section 3'' and to use either a roll which is tapered towards the center as shown in FIG. 3. In order to overcome the mentioned difficulties it is known according to the state of the art as shown in FIGS. 2, 3, 4 and 5 to decrease the diameter of the friction roll from its center towards the points of reverse travel.

Surprisingly, it has been observed that the reduction of the diameters of the friction roll towards the points of reverse travel according to the invention, as described before, may also be carried out on the empty bobbin, instead, and this prevents the disadvantages hitherto encountered as satisfactory as in the case of the friction roll.

Best results are obtained with a device wherein the empty bobbins diameters and the length of the empty bobbin and the winding on the bobbin corresponding to the following unbalanced equations:

a) $0.05 \text{ mm} \leqq e_2 - e_1 \leqq 4 \text{ mm}$, and b) $\frac{l_1 - m_3}{l_1} \leqq$ ,and c) $\frac{l_1 - m_2}{l_1} \leqq 0.3$, where $l_1$ is the length of the winding on the bobbin, $m_2$ is the smallest distance between the sections of the smallest bobbin tube diameter at the points of reverse travel of the transversing device, $m_3$ is the length of the section of unchanged diameter in the center of the empty bobbin between the two sections of decreasing empty bobbin diameter, $e_1$ is the empty bobbin diameter at the points of reverse travel, and $e_2$ is the maximum empty bobbin diameter between the points of reverse travel of the traversing device.

The zone of decreasing diameter (sections 6 and 7 of FIGS. 2, 3 and 6) is shaped as far as possible in such a manner that it corresponds to the profile of the winding in the zone of reverse travel. If it is too large, the surface of the friction roll loses its contact with the winding, which often causes formation of loops.

For manufacturing reasons, however, simple profiles are preferred. Sharp edges and angles must of course be avoided, since milling shall be reduced or even prevented.

The difference between the diameter $e_2$ and $e_1$ of sections 3'' and 7 depends on the special shape of the winding which, among others, is influenced by the geometric correlation of traversing device, friction roll and winding by the alteration of the crossing angle during the winding process and by the yarn properties, for example the friction. In case of feeble piling-up of material at the points of reverse travel, that is, in case of a well optimized winder, the difference between the diameters $e_2$ and $e_1$ should amount to fractions of millimeters only. If there is too much difference between these diameters $e_2$ and $e_1$, the edge structure formation of the winding is disturbed.

As traversing device, the known equipment for the to and fro movement of the yarn over the whole length of the winding may be used, for example yarn traversing guides or split drums.

We claim:

1. A device for winding up yarns on empty bobbins which comprises an empty bobbin rotating on a clamping device, a friction roll contacting the surface of the empty bobbin, a traversing device for the yarn to be wound up, the diameter of the empty bobbin decreasing relative to the center of the empty bobbin in the vicinity of reverse travel of the traversing device, the empty bobbin diameters and the length of the empty bobbin and the winding on the bobbin corresponding to the following unbalanced equations:

a) $0.05 \text{ mm} \leqq e_2 - e_1 \leqq 4 \text{ mm}$ and b) $\frac{l_1 - m_3}{l_1} \leqq 1$, and c) $\frac{l_1 - m_2}{l_1} \leqq 0.3$, where $l_1$ is the length of the winding on the bobbin, $m_2$ is the smallest distance between the sections of the smallest bobbin tube diameter at the points of reverse travel of the traversing device, $m_3$ is the length of the section of unchanged diameter in the center of the empty bobbin between the two sections of decreasing empty bobbin diameter $e_1$ is the empty bobbin diameter at the point of reverse travel, and $e_2$ is the maximum empty bobbin diameter between the points of reverse travel of the traversing device, and both ends of the empty bobbin being provided with starter rings the diameter $e_3$ of which exceeds the diameter $e_2$ by less than 2mm, preferably less than 1.4 mm.

* * * * *